United States Patent [19]

Crew, Jr.

[11] 4,230,320

[45] Oct. 28, 1980

[54] GAME BOARD WITH CORRESPONDING CARDS

[76] Inventor: Norman W. Crew, Jr., 14 Porters Core Rd., Hingham, Mass. 02043

[21] Appl. No.: 942,948

[22] Filed: Sep. 18, 1978

[51] Int. Cl.[3] ..... A63F 3/00

[52] U.S. Cl. ..... 273/243

[58] Field of Search ..... 273/249, 252, 248, 253, 273/243, 254, 250, 255, 251; D21/33, 34, 35

[56] References Cited

U.S. PATENT DOCUMENTS

| | | | |
|---|---|---|---|
| 1,574,394 | 2/1926 | Holme | 273/253 |
| 1,747,767 | 2/1930 | French | 273/249 |
| 4,134,591 | 1/1979 | Brooks | 273/252 |

*Primary Examiner*—Richard C. Pinkham
*Assistant Examiner*—Scott L. Brown
*Attorney, Agent, or Firm*—Herbert L. Gatewood

[57] ABSTRACT

A happiness game in which players move around a path of game board spaces in accordance with a chance device. Alternate playing spaces are indicated by directional arrows. These playing spaces being associated with "frown" playing cards and the "frown" cards being covered by, "smile" cards in accordance with the rules. The object of the game being for each player to cover as many "frowns" as possible.

9 Claims, 6 Drawing Figures

GAME BOARD WITH CORRESPONDING CARDS

BACKGROUND OF THE INVENTION (1) Field Of The Invention

This invention relates to a board game and its manner of play, and more particularly to a board game which may be played by two—four players ranging in age from 7 years upwards, wherein each player is made aware of the fact that by helping others, he finds happiness himself.

(2) Description Of The Prior Art

In the field of education, one method of learning is incidental learning through games. The playing of games necessitates player involvement which has a somewhat greater learning impact on the participants than the traditional "read about" technique.

One area in which incidental learning through gaming is believed to be advantageous is in the teaching of interrelationships with one another. This is believed particularly so in the helping to make others happy, and in the showing of appreciation for one's help by saying "thank you."

Games heretofore have involved the presentation of facial expression indicating happiness and sadness. One such game is disclosed in U.S. Pat. No. 1,340,001 wherein the road to success is shown to result in a happy face, while the road to failure leads to an unhappy one. The game invention in U.S. Pat. No. 3,759,521 is centered around a theme involving distinquishing qualities or traits of a player and "good trait" and "bad trait" cards are acquired or lost by a player, as the game progresses.

However, these games, as I understand their manner of play, do not create an awareness in the players that if one goes out of his way to help another to be happy, he will also be made happy.

SUMMARY OF THE INVENTION

In accordance with my invention, there is provided an educational game in which not only is the unpleasantness taken out of losing a game but the players learn the importance in helping others smile by taking away their frown. A player learns that if he goes out of his way to help another be happy, he can also become happy himself. Whether a winner or loser, the player learns the importance of a "please" and a "thank you."

The invention in its basic aspects comprises a game board on the surface of which is provided a closed circuit of a plurality of individual, serially arrayed player spaces, some of which are provided with indicia instructing a player in an optional course of action, i.e., the giving up of a smile for a frown. This occurs when a player lands on a player space wherein a request for help is made by a person needing help, represented by a "frown face." A player need not help, but if he does he replaces the frown with a smile, and receives a "thank you." A "thank you" has no value to the outcome of the game but only to show appreciation for one's help.

The game ends when all frowns on the game board are covered with smiles. The winner is the player who has helped the most unhappy people (frown faces) and has collected the most frown cards. Unfortunately, that player has had to give away his smile cards to do this, but receives happiness in knowing that he has helped the most unhappy people (frown faces). As everyone would rather see a smile than a frown, and the other second players have more smile cards left than the winner, everyone is a winner.

In its more specific aspects, the game according to the invention comprises a game board on the surface of which is provided a close circuit of a plurality of individual, serially arrayed first player spaces, a starting space in said closed circuit, a row of a plurality of individual, serially arrayed first player spaces interconnecting two of said first player spaces in the closed circuit, indicia on certain of said first third and fourth player spaces, a plurality of second player spaces adjacent to said close circuit and said row each of which is interconnected with at least two of said first player spaces and carrying suitable indicia thereon, at least one each third and fourth player spaces interconnected with one another and each to only one of said first player spaces, a first plurality of cards carrying indicia corresponding to the indicia carried by said second player spaces, a second and third plurality of cards carrying other suitable indicia, a playing piece for each player, and means operable to determine the number of player spaces to be moved on the game board by a player.

BRIEF DESCRIPTION OF THE DRAWING

The invention will be best understood in the following detailed description of a preferred embodiment thereof, taken in connection with the appended drawings in which.

DETAILED DESCRIPTION OF THE INVENTION AND THE PREFERRED EMBODIMENTS

Figure 1:
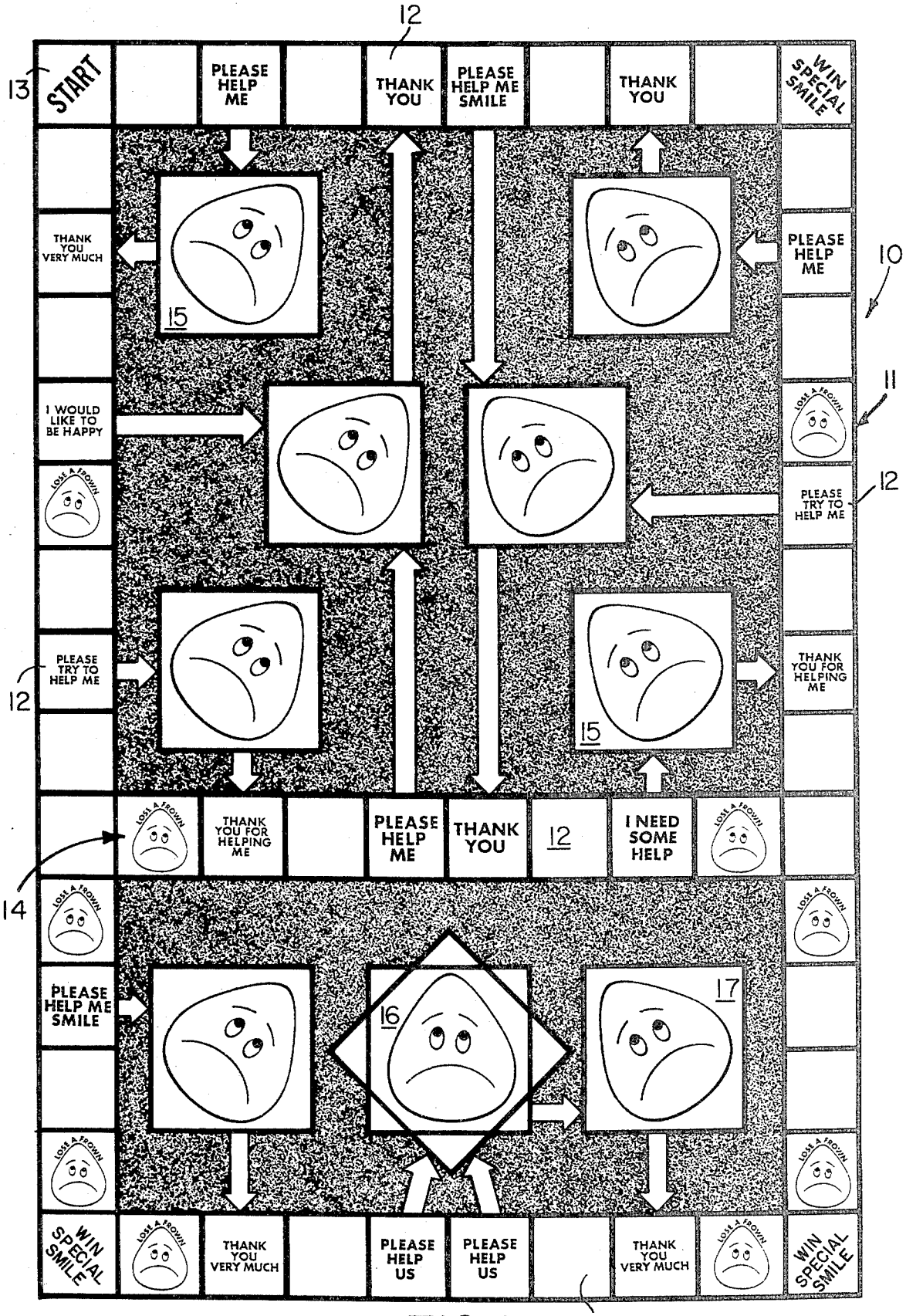
FIG. 1 is a plan view of a game board in accordance with the invention.

In the practice of my invention, there is shown in FIG. 1 of the drawing a so-called game board (10) on the surface of which is provided a closed circuit (11) of individual, serially arrayed first player spaces (12) and in which is provided a starting player space (13). Connecting two player spaces (12) together, as shown in the drawing, there is provided a row (14) of a plurality of individual serially arrayed player spaces (12). A plurality of second player spaces (15) are provided adjacent to the closed circuit (11) and row (14), these being connected as shown by the arrows in the drawing to two separate and spaced apart player spaces (12). Third and fourth player spaces (16), (17) are provided, as shown in FIG. 1, in association with one another and with the closed circuit (11) of player spaces (12). These player spaces are each connected to one another as indicated by the directional arrow and player space (16), being a double space, is connected with two adjacent player spaces (12). Player space (17) is connected to player space (16) and to a single player space (12).

As shown in FIG. 1 of the drawing, certain predetermined player spaces (12) are provided with indicia indicating the need for help, e.g., "Please Help Me"; "I Would Like To Be Happy"; "Please Help Me Smile"; etc. Other playing spaces (12) are provided with an indicia showing an appreciation for the help given, e.g., "Thank You"; "Thank You For Helping Me"; and the like. Of the first player spaces or squares (12) associated with the player spaces (15), one is provided with indicia requesting help and the other showing an appreciation for that help. Player spaces (15) are each provided with a frown face. These frown faces, as can other indicia on the game board, can be directly printed onto the game board.

In close circuit (11) and row (14) of first player spaces (12), there are also randomly provided player spaces (12) carrying indicia characterized by a frown face and the phrase "Lose A Frown." The purpose for this will be disclosed hereinafter.

Contrary to player spaces (15), player spaces (16), (17), also each provided with frown faces, are associated with one another. Player space (16) is associated with two adjacent first player spaces (12), as indicated by the directional arrows; and player space (17) is connected to only one. In each case, the arrow connections indicate the direction of play as hereinafter further made clear.

Figure 2:
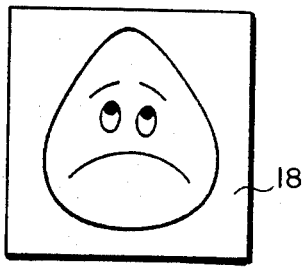
FIGS. 2, 3, and 4 are plan views of playing cards used in the playing of the game.
Figure 3:
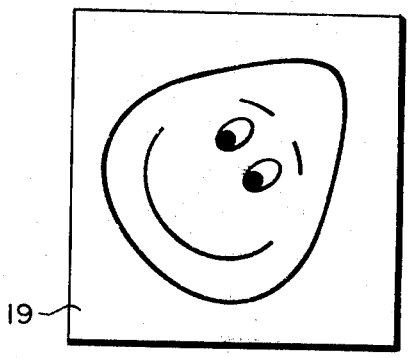
Figure 4:
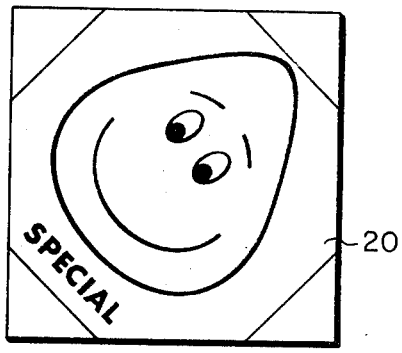

For use with game board (10) in the practice of the invention, there are provided a plurality of playing cards (18), (19), and (20), as shown in FIGS. 2, 3, and 4 of the drawing. Playing cards (18) are each provided with a frown face as shown corresponding to the frown face appearing in player spaces (15). A sufficient number of frown cards (18) are provided to have one each covering a player space (15), (16), and (17). Smile cards (19) are provided in suitably different colors so that each player has at least five smile cards of the same color. As will be appreciated the background color for the smile cards can be of one color and the entire smile face another, if desired. Or the smile face can be merely an outline of the different color. Special smile cards (20) are provided with the same smile face as on smile face cards (19); however, as indicated, the word "Special" is provided on each card. Each card (20) can be further provided, if desired, with corners of a different color than the remainder of the card. This further helps to distinquish the special smile cards (20) from smile cards (19).

Figure 5:
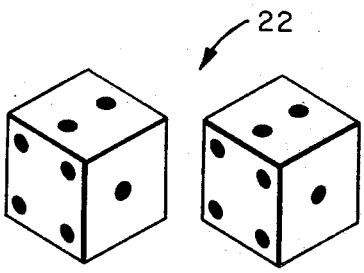
FIG. 5 is a perspective view of a means to determine the number of player spaces to be moved by a player.
Figure 6:
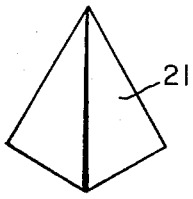
FIG. 6 is a perspective view of a representative player piece to be used in the playing of the game according to the invention.

A player piece or marker (21) is provided for each player, these being of a suitably different color, corresponding to the different colors of smile cards (19). These can be of any configuration desired, the pyramid shape in FIG. 6 merely being representative of a player piece. A means such as dice (22) to determine the number of player spaces to be moved in the play of the game is provided as shown in FIG. 5. However, other means to perform this same function can be used instead of dice, such as a conventional rotating dial. If desired, to limit the number of player spaces moved, one die can be used having the conventional markings from 1 to 6, or dice specifically marked can be used. Actually there is no criticality in limiting the move that a player makes to only 6 spaces. This is a matter of choice.

Although the game board (10) in FIG. 1 of the drawing shows closed circuit (11) to be of a rectangular pattern, it will be appreciated that close circuit (11) can be of other configuration, as desired. For example, closed circuit (11) can be square, or even circular. Row (14) can be linear, or of a wavy configuration. And it can connect opposed player spaces (12), as shown, or player spaces more closely associated, as desired.

In order to play the game according to my invention, frown cards (18) are first placed over the frown faces on player spaces (15), (16), and (17). "Special Smile" cards (20) are then positioned conveniently beside the game board, and in reach of the players. A player receives one of these when ever he lands on one of the three corners of the game board (10) provided with the indicia "Win Special Smile."

Each player takes five smile cards (19) and a marker (21) of the same color, placing the marker (21) at the player space (13) marked "Start." The smile cards (19) are placed in front of a players position for the other players to see. The players than each roll the dice in turn to determine which player starts the game. The player rolling the lowest number on the dice, starts the game, and the other players follow in turn. The play is passed in clockwise direction from player-to-player.

To start the play, the player who goes first rolls the dice again and moves his marker (21) along the closed circuit (11) of the game board the exact number of player spaces (12) determined by the throw of the dice (22). Each player than follows in turn, rolling the dice (22) and moving his marker (21) the determined number of spaces. When a player approaches the intersection made by row (14) with closed circuit (11), he can determine whether to continue in closed circuit (11) or to move his marker along row (14).

At the start of the game, a player may move his marker (21) in either direction from the starting position (13); and during the game a player may move in which ever direction desired. The starting player space (13) in the latter case is treated as any other player space (12). There are no double moves, even though doubles are thrown on the dice (22) in the case that two correspondingly numbered dice are used.

As a major object of the game is to help as many frown faces as possible turn to smiles, in moving around the game board, a player should try to land on a "Please Help Me" player space, or a "Win A Special Smile" space. He should avoid a player space carrying the indicia "Lose A Frown." The reason for this will be later explained.

A player landing on a "Please Help Me" space may, but is not required to, help the accompanying frown face turn to a smile. However, it should be remembered that the winner of the game is the player who has helped the most frown faces turn to a smile. This is done by the player moving his marker from the "Please Help Me" player space in the direction of the arrow to that player space (15) bearing the frown face. The player then takes one of his smile cards (19) and exchanges it for the frown card (18), moving his marker (21) to the player space (12) pointed to by the arrow on which is provided the indicia "Thank You." A player obviously may only help to change a frown to a smile, if he has a smile card (19) to exchange for a frown card (18).

A player landing on a "Please Help Me" player space or a "I Would Like To Be Happy" player space associated with a player space (15) on which has been placed another player's smile card (19) may, but is not required to, help that player lose a frown card (18). This is accomplished by returning the players smile card (19) from the game board to him in exchange for that player's frown card (18). The player involved then simply retains the frown card (18) in his hand, placing his own smile card (19) on game board (10) over the frown in the appropriate player space (15). He then moves his marker to the indicated associated "Thank You" player space (12). This can be done by any player as often as the occasion arises.

There are, as shown in FIG. 1, two first player spaces (12) on game board (10) entitled "Please Help Us" associated with a third player space (16), showing a double frown, or two people in need of help. When a player lands on either of these player spaces (12), two smile cards are exchanged for the frown card.

A player landing on a "Win Special Smile" player space (12) (one is provided at three corners of the game board) takes a special smile card (20) from the deck of cards. However, this can be done only if the player has already used his regular smile cards (19) in play. The "Special Smile" cards are then used in the same manner as the regular smile cards to help frowns change to smiles.

When a player lands on a "Lose A Frown" player space or square (12), he must, if he has one, return a frown to the board in exchange for one of his own smile cards. A player may choose which smile card he wishes to take back in the event there is a choice available. A player that does not have a frown card to return to the board loses his next turn.

The game ends when all frowns on the game board (10) are covered with smile cards (19), or a special smile card (20). The winner is a player who has helped the most unhappy people (frown faces) and has collected the most frown cards. If there is a tie, all players play until the tie is broken.

Although in the usual manner of play of the "Game of Happiness", five smile cards (19) are used, the game can be made somewhat more difficult by each player taking fewer than five cards. It can also be made easier if each player is given more than five regular smile cards, e.g., six or seven.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. A game comprising a game board on the surface of which is provided a closed circuit of a plurality of individual, serially arrayed first player spaces, a starting space within said closed circuit, a row of a plurality of individual, serially arrayed first player spaces interconnecting two spaced-apart, somewhat oppositely located of said first player spaces in said closed circuit, a plurality of second player spaces adjacent to said closed circuit and said row of first player spaces, each of which said second player spaces is interconnected by directional arrows with at least two of said first player spaces and said arrows pointing in only one direction from one said first player space to another of said first player spaces, said first and second player spaces carrying suitable indicia thereon, at least one each third and fourth player spaces adjacent to said closed circuit and row of first player spaces and interconnected with one another by a directional arrow pointing in only one direction, said third player space being a double space and connected by direction arrows to two adjacent first player spaces, the directional arrows pointing only from the first player spaces to the third player space, and said fourth player space being additionally connected by directional arrow pointing only to a first player space, indicia on said third and fourth player spaces, a first plurality of cards carrying indicia corresponding to the indicia carried by said second and third and fourth player spaces, a second and third plurality of cards carrying other suitable indicia, a playing piece for each player, and means operable to determine the number of player spaces to be moved on the game board by a player.

2. Game according to claim 1 wherein the closed circuit of the game board comprises a pair of linearly arrayed first player spaces, and said row of first player spaces connects one player space in one said linear arrayed player spaces with another player space in the other of said pair.

3. Game according to claim 1 wherein said connected first player spaces are directly opposed to one another.

4. Game according to claim 1 wherein certain of the first player spaces are provided with indicia requesting help, and certain of other said first player spaces are provided with an expression of thank you and these said first player spaces are connected to said second player spaces.

5. Game according to claim 1 wherein the indicia on said second player spaces is a frown face and indicia on the first plurality of cards is a corresponding frown face.

6. Game according to claim 1 wherein the indicia provided on the second and third plurality of cards is a smile face.

7. Game according to claim 1 wherein certain of said first player spaces are provided with indicia indicating loss of a frown.

8. Game according to claim 1 wherein the closed circuit of first player spaces is of a rectangular shape and said row of first player spaces is linear and connects first player spaces in said circuit which are generally opposite from one another.

9. Game according to claim 1 wherein certain of said first player spaces are provided with indicia indicating that the player wins a special smile.

* * * * *

UNITED STATES PATENT AND TRADEMARK OFFICE

CERTIFICATE OF CORRECTION

PATENT NO. : 4,230,320

DATED : October 28, 1980

INVENTOR(S) : Norman W. Crew, Jr.

It is certified that error appears in the above-identified patent and that said Letters Patent are hereby corrected as shown below:

Address of Patentee should read - 14 Porters Cove Road -;

Column 2, Line 1, delete "second";

Column 2, Line 10, delete "third and fourth";

Column 3, Line 3, insert - second - before the word "player";

Column 3, Line 14, insert - third and fourth - before the word "player", second occurrence; and Column 5, Lines 28, 29, the "Game of Happiness" should read - game disclosed -.

Signed and Sealed this

*Thirty-first* Day of *March 1981*

[SEAL]

*Attest:*

RENE D. TEGTMEYER

*Attesting Officer*

*Acting Commissioner of Patents and Trademarks*